US005491543A

United States Patent [19]

Renbutsu

[11] Patent Number: 5,491,543

[45] Date of Patent: Feb. 13, 1996

[54] TRANSFER ROLLER CONTROLLED TO POSITION THE PAPER IN REGISTRATION WITH THE TONER IMAGE

[75] Inventor: Tadashi Renbutsu, Gifu, Japan

[73] Assignee: Sanyo Electric Co., Ltd., Moriguchi, Japan

[21] Appl. No.: 231,198

[22] Filed: Apr. 21, 1994

[30] Foreign Application Priority Data

Apr. 21, 1993 [JP] Japan ..... 5-118992

[51] Int. Cl.[6] ..... G03G 15/14

[52] U.S. Cl. ..... 355/271; 355/317

[58] Field of Search ..... 355/277, 271, 355/317, 208

[56] References Cited

U.S. PATENT DOCUMENTS

| | | | |
|---|---|---|---|
| 3,751,156 | 8/1973 | Szostak et al. | 355/273 |
| 4,302,093 | 11/1981 | Landa | 355/277 X |
| 5,318,631 | 6/1994 | Tsukamoto | 355/277 X |

FOREIGN PATENT DOCUMENTS 4-216568 8/1992 Japan .

*Primary Examiner*—Nestor R. Ramirez
*Attorney, Agent, or Firm*—Darby & Darby

[57] ABSTRACT

An image forming apparatus includes a photosensitive drum. A transfer roller is arranged in a manner that a periphery of the transfer roller is brought close to a peripheral surface of the photosensitive drum, and a PE sensor is arranged in front of the transfer roller, and paper leading end sensor is arranged in back of the transfer roller. When a paper supplied from a paper hopper is detected by the PE sensor, the photosensitive drum and the transfer roller are rotated, and therefore, the paper is fed until a leading end thereof is detected by the leading end sensor. The photosensitive drum and the transfer roller are independently driven by a main motor and a transfer motor, respectively. A printing operation is started in response to a print command, the paper is further fed by the photosensitive drum and the transfer roller, and then, when the leading end sensor does not detect the paper, the photosensitive drum and the transfer roller are stopped.

15 Claims, 19 Drawing Sheets

WAITING STATE

TRANSFERRING STATE

WAITING STATE

TRANSFERRING STATE

WAITING STATE

TRANSFERRING STATE

WAITING STATE

TRANSFERRING STATE

TRANSFER ROLLER CONTROLLED TO POSITION THE PAPER IN REGISTRATION WITH THE TONER IMAGE

BACKGROUND OF THE INVENTION

1. Field of the Invention

The present invention relates to an image forming apparatus. More specifically, the present invention relates to an image forming apparatus which is incorporated in or combined with a portable word processor, a desk top type or lap top type computer, a facsimile and other similar devices.

2. Description of the Prior Art

In the recent years, in accordance with the spread of a portable word processor, a desk top type or lap top type computer, a facsimile and others similar devices, a simple and compact image forming apparatus having the fundamental functions of such an apparatus is required.

An image forming apparatus which is disclosed in, for example, Japanese Patent Application Laying-Open No. 4-216568 and having simplified structure has been proposed. In such an image forming apparatus, a register roller is omitted, and a paper is fed to a transfer roller or a fixing device only by a paper feeding roller.

However, in the prior art, the paper is fed only by the paper feeding roller without the use of a register roller which is for surely positioning a leading end of the paper. Therefore, if leading ends of papers stacked in a paper storage portion are not precisely aligned or if a slip occurs in feeding papers, a variation occurs in a timing that the paper is fed on the transfer roller. Therefore, even if the same image is to be formed on the papers, image positions on respective papers deviate from each other. Therefore there was a problem in the prior art that the positioning accuracy of the paper is not so good.

SUMMARY OF THE INVENTION

Therefore, a principal object of the present invention is to provide a novel image forming apparatus.

Another object of the present invention is to provide a compact image forming apparatus with simple structure.

Another object of the present invention is to provide an image forming apparatus in which the positioning accuracy of paper is good.

An image forming apparatus according to the present invention comprises: an image forming member; a transfer roller for transferring a toner image formed on the image forming member onto a paper; and control means for independently controlling the rotation of the transfer roller and an operation of the image forming member.

More specifically, the image forming apparatus further comprises first detecting means for detecting a paper fed to the transfer roller, second detecting means for detecting a paper fed from the transfer roller, a transfer motor for controlling an operation of the transfer roller, and input means for inputting a command for image forming.

Therefore, when the paper is detected by the first detecting means, the transfer roller is rotated by the transfer motor such that the paper is fed. Then, if a leading end of the paper is detected by the second detecting means, the transfer roller is stopped by the transfer motor. Furthermore, when the leading end of the paper is detected by the second detecting means, as necessary, the transfer roller is rotated in a forward direction by the transfer motor such that the paper is further fed in a forward direction, or the transfer roller is rotated in a backward direction such that the paper is fed in a backward direction, whereby the paper can be positioned at a desired position. Thereafter, when the command is inputted by the input means, the transfer roller is rotated in the forward direction by the transfer motor such that the paper is fed in the forward direction, and then, when the paper passes the second detecting means and thus the paper is in a position not to be detected by the second detecting means, the feeding of the paper is stopped by the transfer motor.

A plunger may be utilized instead of the transfer motor. In such a case, even when the paper is detected by the first detecting means, the rotation of the transfer roller is not stopped by the plunger, and the same is driven by an operation of the photosensitive member. Thereafter, when the leading end of the paper is detected by the second detecting means, the rotation of the transfer roller is stopped by the plunger. Then, even when the command is inputted from the input means, the transfer roller is not stopped by the plunger, and the same is driven again by the operation of the image forming member. Thereafter, when the paper is in a position not to be detected by the second detecting means, the rotation of the transfer roller is stopped by the plunger.

In another aspect of the present invention, an image forming apparatus further comprises a paper supply unit in which a paper is accommodated, and a paper supply roller for supplying a paper from the paper supply unit to the transfer roller. Then, if the command is inputted from the input means, the paper is fed toward the transfer roller by the paper supply roller, and when the paper is detected by the first detecting means, the rotation of the paper feeding roller is stopped after a predetermined time. Thereafter, the transfer roller is rotated by the transfer motor and the paper supply roller is rotated again, and therefore, the paper is further fed. Then, if the paper is in a position not to be detected by the second detecting means, the paper supply roller and the transfer roller are stopped. In addition, a plunger may be utilized instead of the transfer motor.

In accordance with the present invention, since the transfer roller is controlled independently from the operation of the image forming member, it is possible to achieve positioning of the paper with high accuracy and without the use of the register roller, and therefore, it is possible to obtain a simple and compact image forming apparatus.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
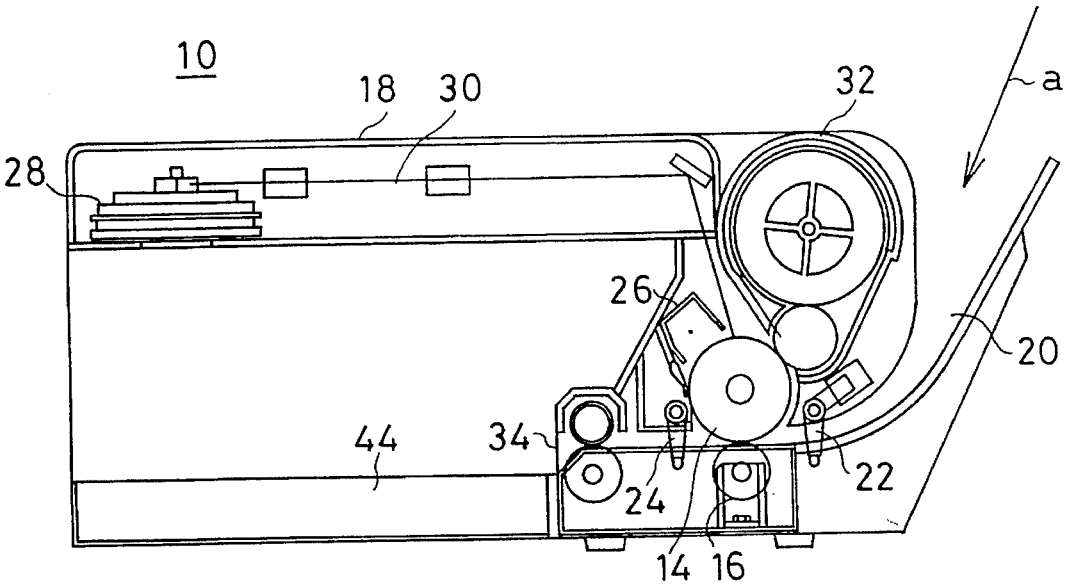
FIG. 1 is a cross-sectional illustrative view showing an image forming apparatus of one embodiment according to the present invention.
Figure 2A:
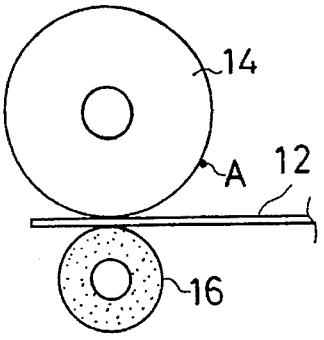
FIG. 2A is an illustrative view showing a waiting state in the FIG. 1 embodiment of a horizontal paper feeding system.
Figure 2B:
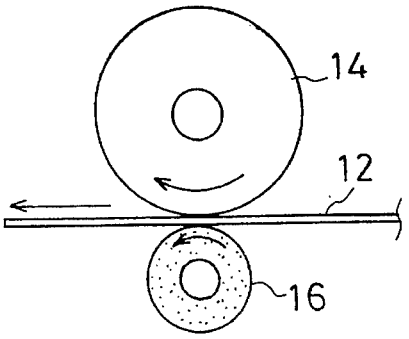
FIG. 2B is an illustrative view showing a transferring state in the FIG. 1 embodiment.

An image forming apparatus 10 which is shown in FIG. 1 and one embodiment according to the present invention is of a horizontal paper feeding system in which a paper 12 is fed in a horizontal direction. A state in which the paper is sandwiched between a photosensitive drum 14 and a transfer roller 16, as shown in FIG. 2A, is a waiting state, and thereafter, the paper 12 is further fed in a transferring state as shown in FIG. 2B.

Referring to FIG. 1, the image forming apparatus 10 of this embodiment shown includes a housing 18 in which a photosensitive drum 14, which is an image forming member, is incorporated, and a transfer roller 16 is arranged in a manner that a periphery of the transfer roller 16 is brought into contact with a lower periphery of the photosensitive drum 14. That is, the photosensitive drum 14 is brought into pressure-contact with the transfer roller 16. Then, a paper 12 is supplied from a paper supply hopper 20 as indicated by an arrow mark a. In front of the photosensitive drum 14 and the transfer roller 16, that is, in a right side portion of FIG. 1, a PE sensor 22 for detecting the presence or absence of the paper 12 is arranged, and in back of the photosensitive drum 14 and the transfer roller 16, that is, in a left side portion of FIG. 1, a paper leading end sensor 24 for detecting a leading end of the paper 12 is arranged. Each of the PE sensor 22 and the leading end sensor 24 includes a lever having one end which is supported in a rotatable manner, and the lever is pushed by the paper 12 and changed in its position, whereby the paper is detected. After the paper 12 passes through the lever, the lever is returned to its home position, whereby the paper 12 becomes not to be detected. That is, each of the PE sensor 22 and the leading end sensor 24 is turned-on by pressure of the paper, and turned-off by removing the pressure of the paper 12. Therefore, when the leading end sensor 24 is turned-off, a trailing end of the paper 12 is resultingly detected.

A charger 26 for uniformly charging a surface of the photosensitive drum 14 is arranged above the photosensitive drum 14. A laser 28 constituting part of an optical system is arranged in an upper portion of the inside of the housing 18, and the photosensitive drum 14 is light-exposed by an optical signal 30 from the laser 28, whereby an electrostatic latent image is formed on the photosensitive drum 14. In addition, a developer 32 is arranged in the vicinity of the photosensitive drum 14, and toner is supplied to the photosensitive drum 14 from the developer 32. Furthermore, in back of the leading end sensor 24, that is, in a right side portion of FIG. 1, a fixing device 34 is arranged.

Figure 3:
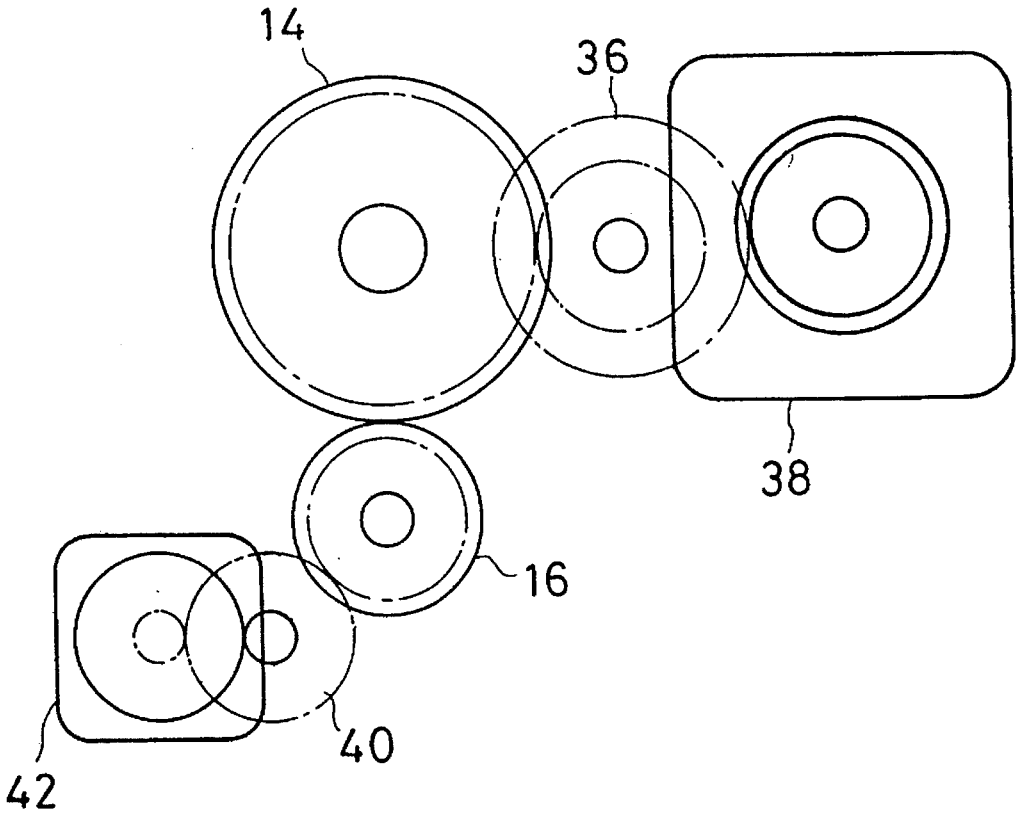
FIG. 3 is an illustrative view showing one example of a major portion of the FIG. 1 embodiment.

A major portion of the image forming apparatus 10 is constructed as diagrammatically shown in FIG. 3. With referring to FIG. 3, the photosensitive drum 14 is driven by a main motor 38 via a transmission gear 36, and the transfer roller 16 is driven by a transfer motor 42 via a transmission gear 40.

Figure 4:
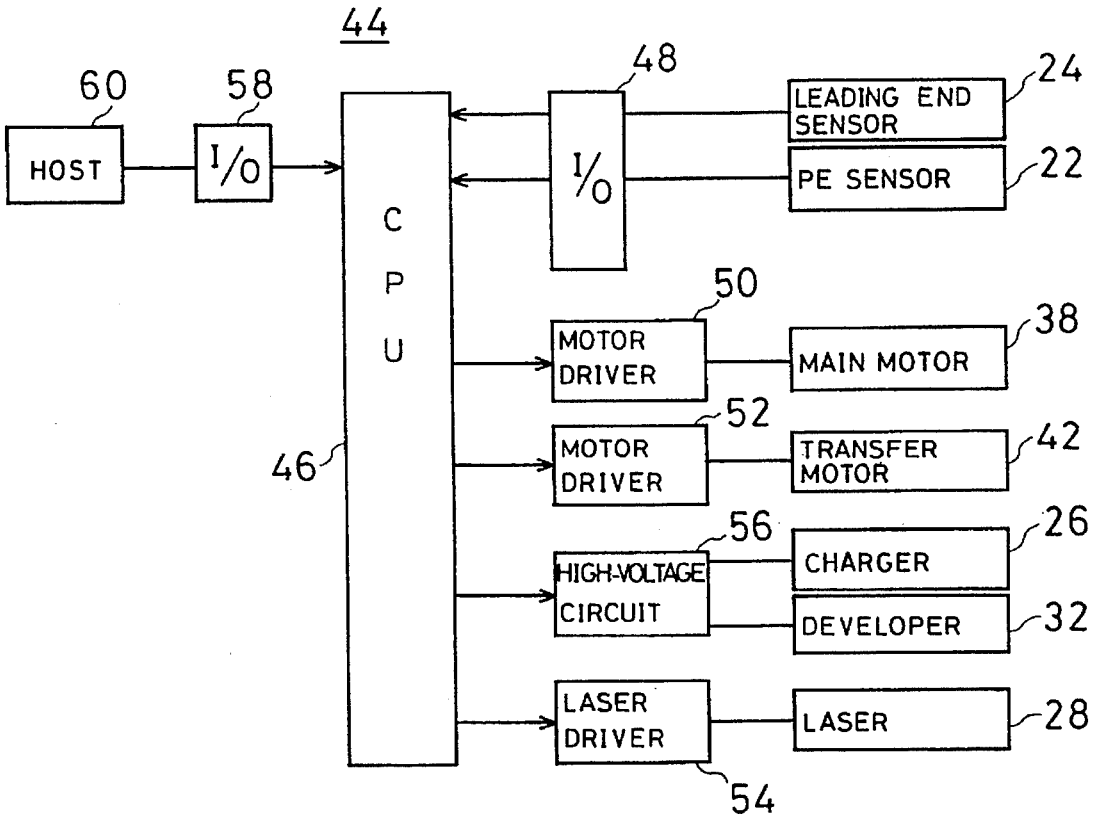
FIG. 4 is a block diagram showing the circuit structure of the FIG. 1 embodiment.

Returning to FIG. 1, in a lower portion of the inside of housing 18, a control circuit 44 for controlling the operation of the image forming apparatus 10 is arranged. The control circuit 44 is constructed as shown in FIG. 4. The control circuit 44 includes a CPU 46 to which the PE sensor 22 and the leading end sensor 24 are connected via an I/O interface 48. Furthermore, the CPU 46 controls the main motor 38 via a motor driver 50, and the transfer motor 42 is controlled by a motor driver 52, and the laser 28 is controlled via a laser driver 54. Furthermore, a high-voltage circuit 56 is controlled by the CPU 46, so that a charging voltage of the charger 26 and a developing bias for the developer 32 are set by the high-voltage circuit 56, respectively. In addition, a host device 60 such as a personal computer is connected to the CPU 46 via an I/O interface 58.

Figure 5:
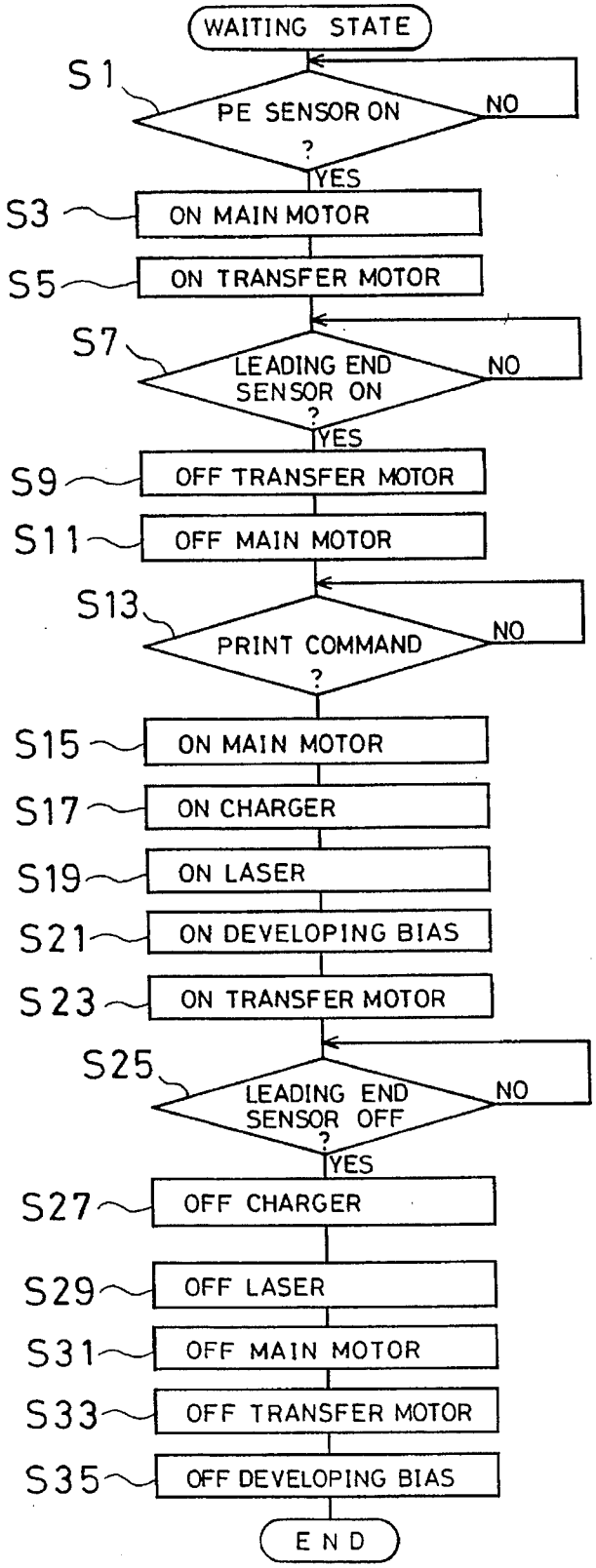
FIG. 5 is a flowchart showing an operation of the FIG. 1 embodiment.

Referring to FIG. 5, an operation of the image forming apparatus 10 will be described. At first, the paper 12 is inserted from an upper position obliquely by a hand-insertion to the paper supply hopper 20 of the image forming apparatus 10 in the waiting state as shown by the arrow mark a in FIG. 1. The paper 12 is guided to a lower portion of the paper supply hopper 20, and then, the paper 12 is injected between the photosensitive drum 14 and the transfer roller 16. At this time, in a step S1, it is detected by the PE sensor 22 whether or not the paper 12 is supplied.

When the lever of the PE sensor 22 is pushed by the paper 12, the PE sensor 22 outputs a signal indicating that the paper 12 is supplied. In a step S3, in response to the paper supply signal, the main motor 38 is turned-on, and in a step S5, the transfer motor 42 is turned-on. Therefore, the photosensitive drum 14 is rotated in a clockwise direction, and the transfer roller 16 is rotated in a counter-clockwise direction, so that the paper is further fed by the photosensitive drum 14 and the transfer roller 16. If, the leading end of the paper 12 is detected by the leading end sensor 24, in a step S7, the transfer motor 42 is tuned-off in a step S9, and the main motor 38 is turned-off in a step S11. Accordingly, the feeding of the paper is stopped, and the image forming apparatus 10 is brought in the waiting state as shown into FIG. 2A.

If, a start key (not shown) of the host device 60 is operated, a print command is inputted to the CPU 46, so that the printing is started in a step S13. Therefore, in a step S15, the main motor 38 is turned-on again. In a step S17, a charging voltage is applied to the charger 26 in a step 17, whereby the photosensitive drum 14 is uniformly charged by the charger 26. Then, in a step S19, the laser 28 is turned-on, and the photosensitive drum 14 is light-exposed by the optical signal 30 outputted from the laser 28, so that an electrostatic latent image is formed on the surface of the photosensitive drum 14. In a step S21, a developing bias is applied to the developer 32, and therefore, a toner is supplied onto the surface of the photosensitive drum 14 from the developer 32. Therefore, the toner is supplied onto the electrostatic latent image, and accordingly, a toner image is formed on the surface of the photosensitive drum 14. Then, in a step S23, the transfer motor 42 is again turned-on to be rotated. In accordance with the rotation of the transfer roller 16, the toner image is transferred onto the paper 12 from the photosensitive drum 14. The paper onto which the toner image is transferred is fed to the fixing device 34 by the photosensitive drum 14 and the transfer roller 16, so that the toner image is fixed on the paper 12 by the fixing device 34. Thus, by turning-on again the transfer roller 16 at a time that a leading end portion A of the toner image on the photosensitive drum 14 (FIG. 2A) is coincident with a leading position of the image on the paper 12, the paper 12 is fed-in between the photosensitive drum 14 and the transfer roller 16 as shown in FIG. 2B. Therefore, the toner image is transferred onto the paper 12 from the photosensitive drum 14 at a desired or predetermined position.

Then, in a step S25, the trailing end of the paper 12 passes the leading end sensor 24, and therefore, the leading end sensor 24 is turned-off. That is, in the step S25, the trailing end of the paper 12 is detected by the leading end sensor 24. When the trailing end of the paper 12 is detected, the charging voltage for the charger 26 is turned-off in a step S27, and the laser 28 is turned-off in a step S29. Next, the main motor 38 is turned-off in a step S31, and the transfer motor 42 is turned-off in a step S33, and the developing bias for the developer 32 is turned-off in a step S35, whereby the image forming operation is terminated.

In the above described embodiment, the timing for feeding the paper 12 is adjusted by the turning-on/off of the transfer roller 16, and therefore, it is possible to omit a register roller and a paper feeding roller which were required in a conventional apparatus, and therefore, it is possible to make the structure of the image forming apparatus 10 very simple. Accordingly, the cost of the image forming apparatus can be reduced largely, and a compact image forming apparatus is obtainable. In the above described embodiment, it is possible to design the image forming apparatus 10 in which a distance between the photosensitive drum 14 and the entrance of the paper supply hopper 20 is made within 10 mm.

Figure 6:
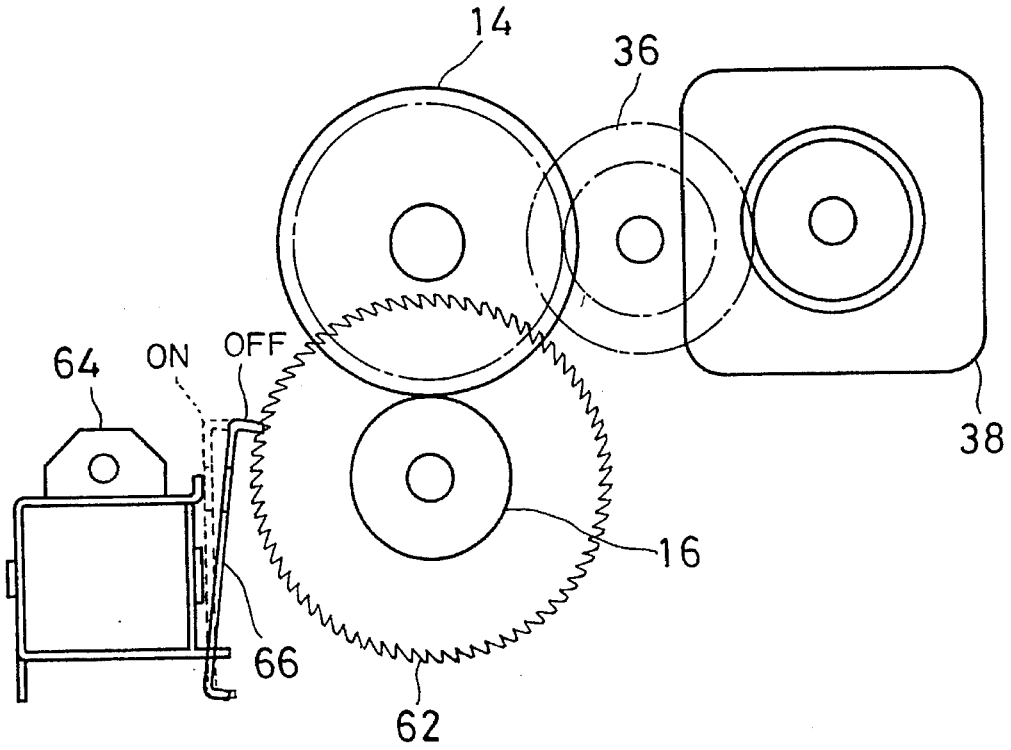
FIG. 6 is an illustrative view showing a modified example of a major portion of the feed mechanism.

The major portion of the image forming apparatus 10 shown in FIG. 1 may be constructed as shown in FIG. 6. Referring to FIG. 6, the transfer roller 16 and the photosensitive drum 14 are brought into pressure-contact with each other, and therefore, when the photosensitive drum 14 is rotated, the transfer roller 16 is driven by the photosensitive drum 14 due to a friction force between the photosensitive drum 14 and the transfer roller 16. A gear 62 is directly coupled to the transfer roller 16, and a plunger 64 is arranged in the vicinity of the gear 52. Therefore, when the plunger 64 is turned-off and an engaging portion 66 of the plunger 64 is engaged with the gear 62 and the rotation of the transfer roller 16 is stopped. On the other hand, if the plunger 64 is turned-on, the engagement of the engaging portion 66 of the plunger 64 to the gear 62 is released, and therefore, the transfer roller 16 can to be driven by the photosensitive drum 14.

Figure 7:
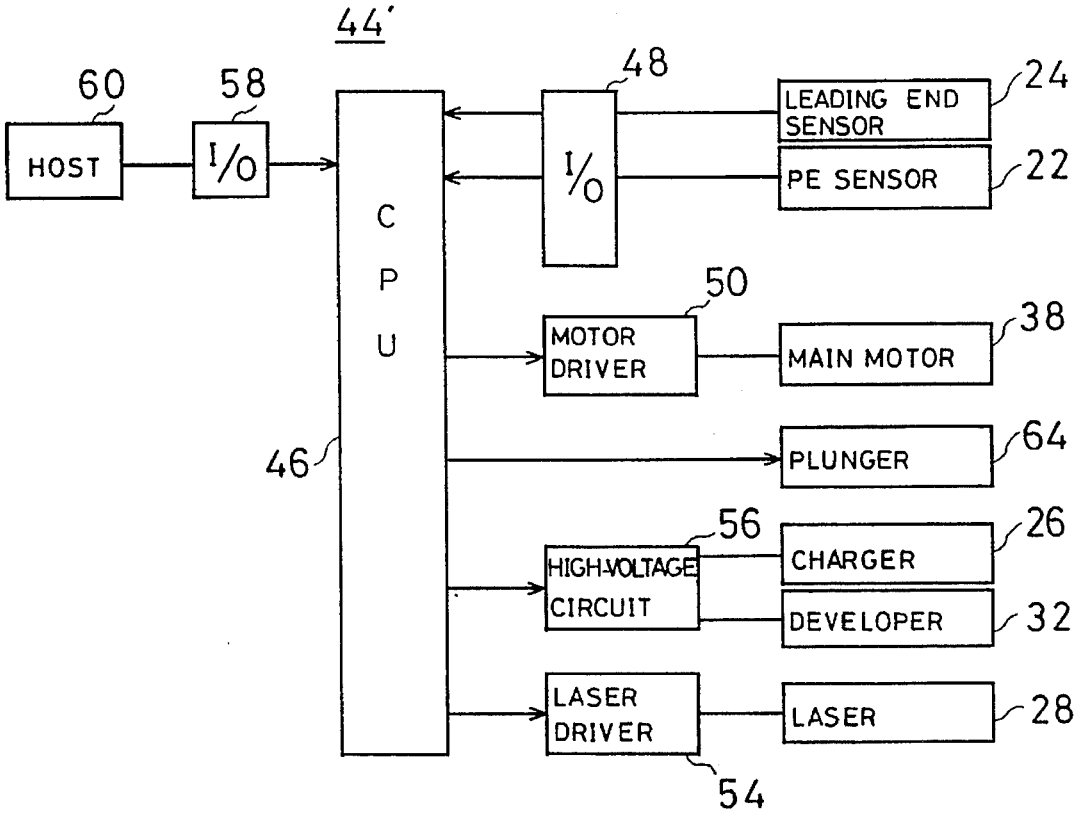
FIG. 7 is a block diagram showing circuit structure of an image forming apparatus in which the major portion of the FIG. 6 is incorporated in FIG. 1 embodiment.

In a case where the major portion shown in FIG. 6 is utilized in the image forming apparatus 10 shown in FIG. 1, a control circuit 44' is constructed as shown in FIG. 7. As seen from a comparison of FIG. 4 and FIG. 7, the control circuit 44' does not include the motor driver 52, and the plunger 64 is directly controlled by the CPU 46. The remaining structural portions are the same or similar to that of the FIG. 4 control circuit 44, and therefore, a duplicate description will be omitted here.

Figure 8:
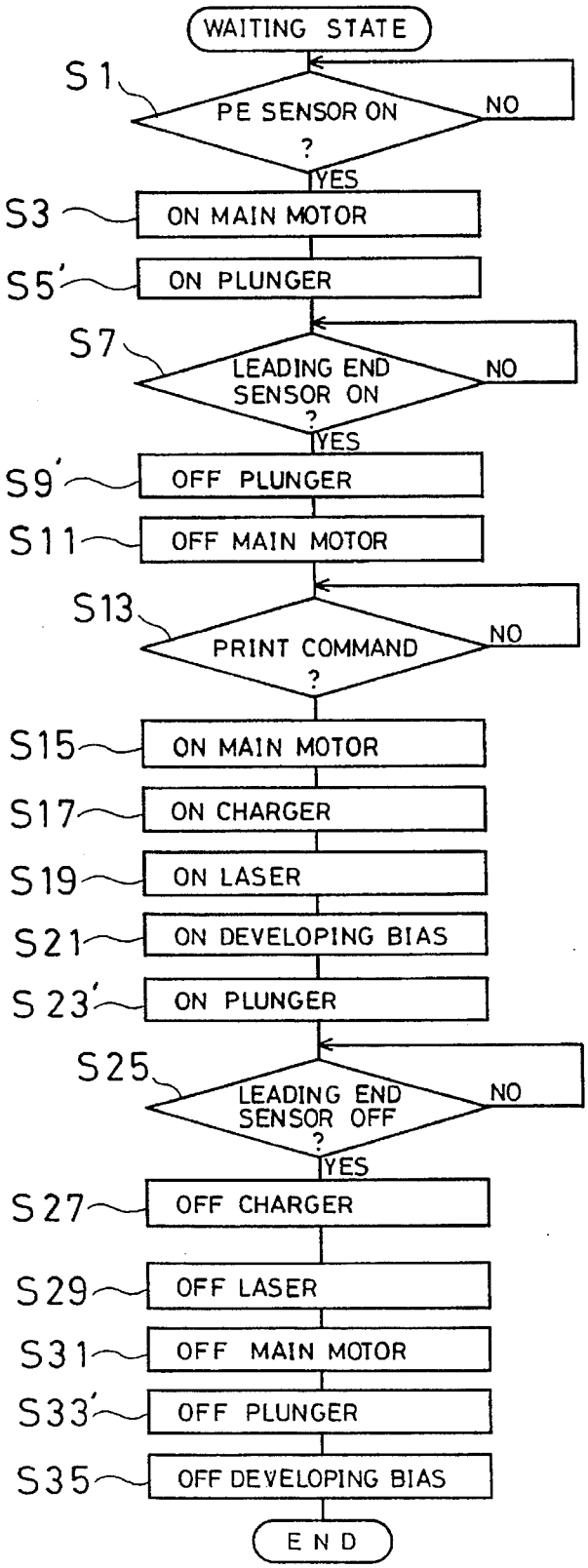
FIG. 8 is a flowchart showing an operation of the FIG. 7 embodiment.

An operation of the image forming apparatus 10 in which the major portion shown in FIG. 6 is utilized will be described with referring to FIG. 8. In addition, the operation of such image forming apparatus 10 is approximately the same or similar to the operation of the previous embodiment shown in FIG. 5, and therefore, in the following, a duplicate description is omitted, and only the difference will be described. Since the plunger 64 is utilized instead of the transfer motor 42, the turning-on/off of the transfer motor 42 described in the steps S5, S9, S23 and S33 in FIG. 5 are changed to the turning-on/off of the plunger 64 in steps of S5', S9', S23' and S33' in FIG. 8. Therefore, when the plunger 64 is turned-on, the transfer roller 16 is rotated by being driven by the photosensitive drum 14, and when the plunger 64 is turned-off, the rotation of the transfer roller 16 is stopped.

Figure 9:
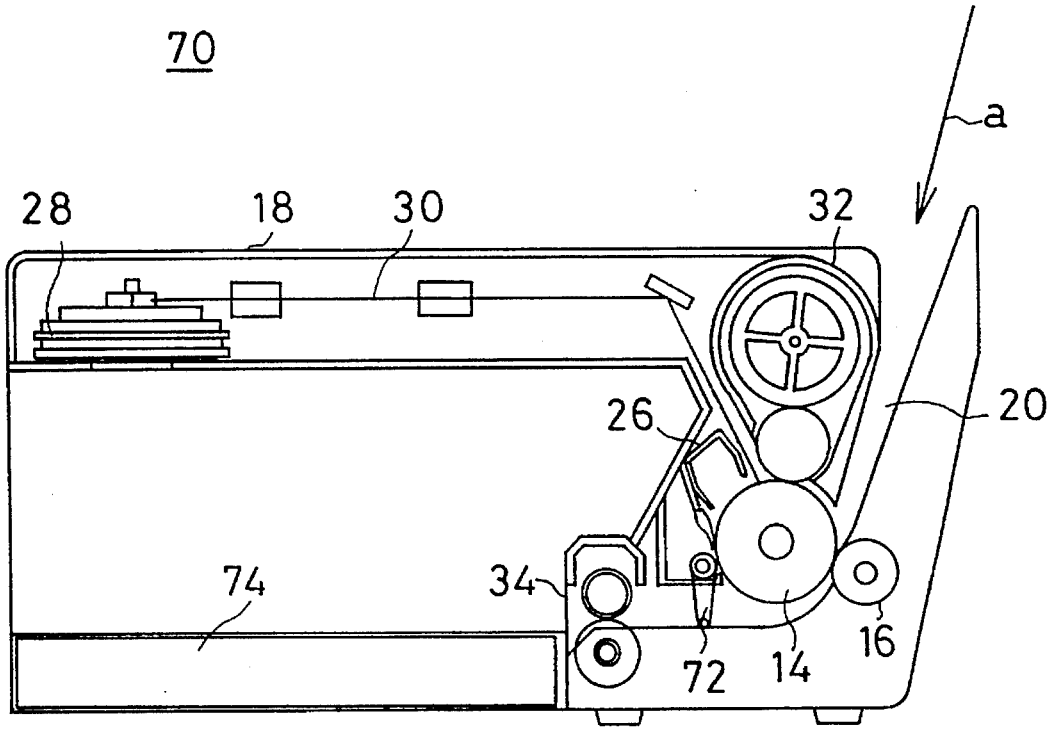
FIG. 9 is a cross-sectional illustrative view showing an image forming apparatus of another embodiment according to the present invention.
Figure 11:
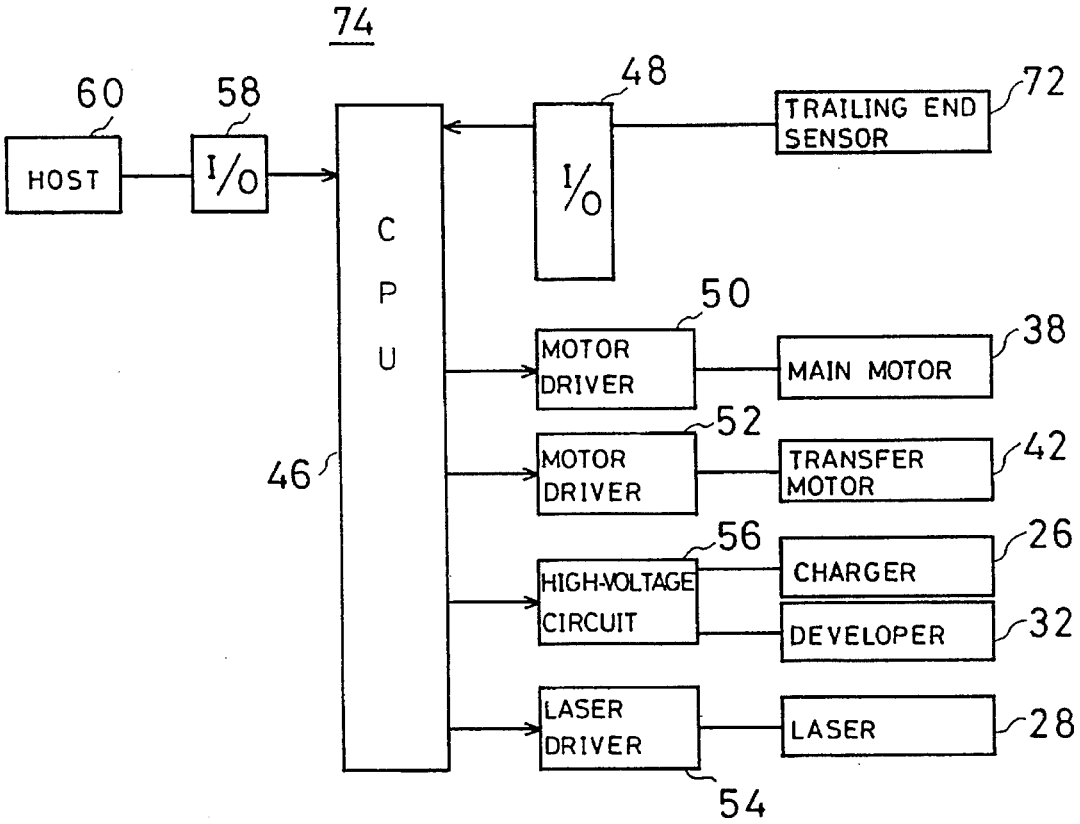
FIG. 11 is a block diagram showing a circuit structure of the FIG. 9 embodiment.

Referring to FIG. 9, an image forming apparatus 70 of another embodiment according to the present invention, the transfer roller 16 is arranged such that the periphery of the transfer roller 16 is brought into pressure-contact with a side periphery of the photosensitive drum 14 (the right side periphery in FIG. 9 embodiment), and therefore, the paper 12 is inserted downward by a hand-insertion from the paper supply hopper 20 as shown by an arrow mark a in FIG. 9. In back of the photosensitive drum 14, that is, in a left side portion of FIG. 9, a paper trailing end sensor 72 for detecting a trailing end of the paper 12 is arranged. As similar to the aforementioned PE sensor 22 and the paper leading end sensor 24, the trailing end sensor 72 includes a lever having one end which is supported in a rotatable manner. The trailing end sensor 72 detects the trailing end of the paper 12 when the lever is returned to a home position thereof. More specifically, the lever of the trailing end sensor 72 is pushed by the paper 12, and then, if the paper 12 passes through the lever, the lever is returned to its original state (a state shown in FIG. 9), and therefore, the trailing end sensor 72 is turned-off, so that the paper becomes not to be detected by the trailing end sensor 72, and accordingly, the trailing end of the paper 12 can be detected. A control circuit 74 of the image forming apparatus 70 in which the major portion having the structure shown in FIG. 3 is utilized is constructed as shown in FIG. 11. As seen from the comparison of FIG. 4 and FIG. 11, the control circuit 74 is constructed by omitting the PE sensor 22 of the control circuit 44 shown in FIG. 4. The remaining structural portions of the image forming apparatus 70 are the same or similar to that of the image forming apparatus 10 shown in FIG. 1.

Figure 12:
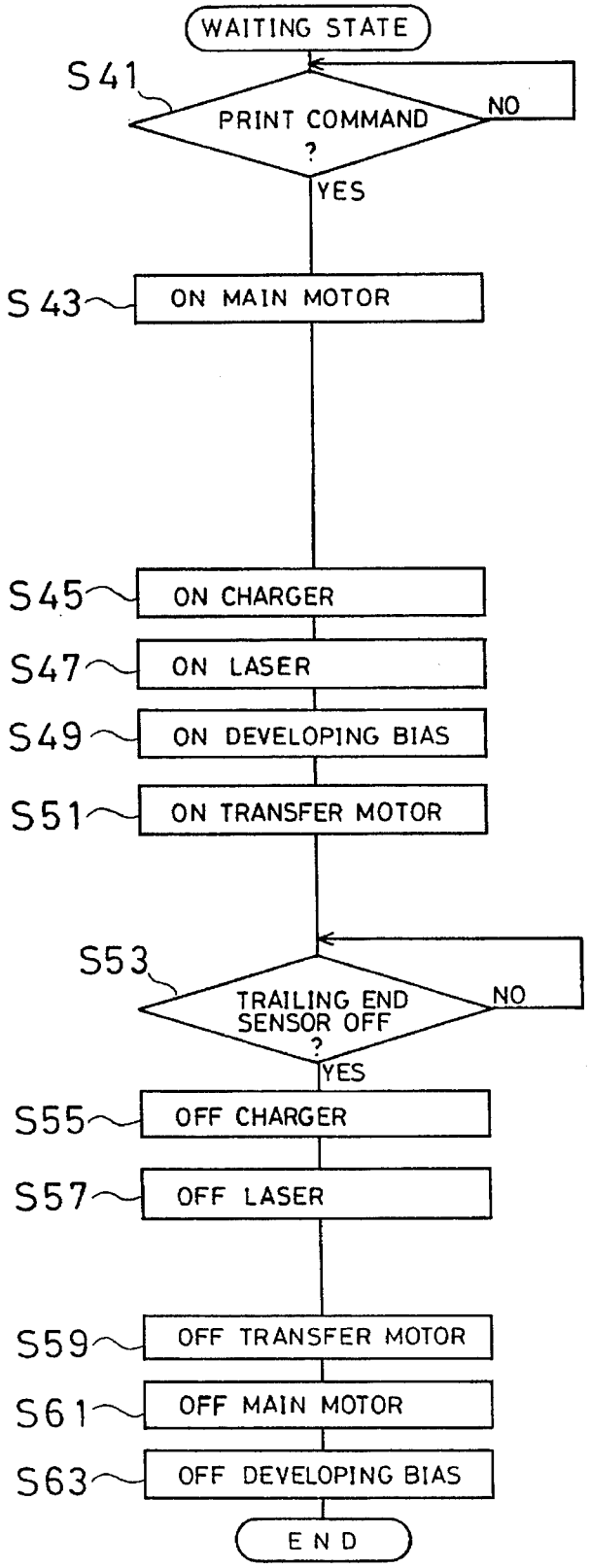
FIG. 12 is a flowchart showing an operation of the FIG. 11 embodiment.

Referring to FIG. 12, an operation of the image forming apparatus 70 will be described. At first, in a waiting state of the image forming apparatus 70 shown in FIG. 10A, the paper 12 comes into a contact point of the photosensitive drum 14 and the transfer roller 16 from the paper supply hopper 20. Then, if a print command is inputted from the host device 60 in a step S41, a printing operation is started.

More specifically, the main motor 38 is turned-on in a step S43, and a charging voltage is applied to the charger 26 in a step S45, and the laser 28 is turned-on in a step S47, and a developing bias is applied to the developer 32 in a step S49, and the transfer motor 42 is turned-on in a step S51, so that a series of printing operations are performed.

Figure 10A:
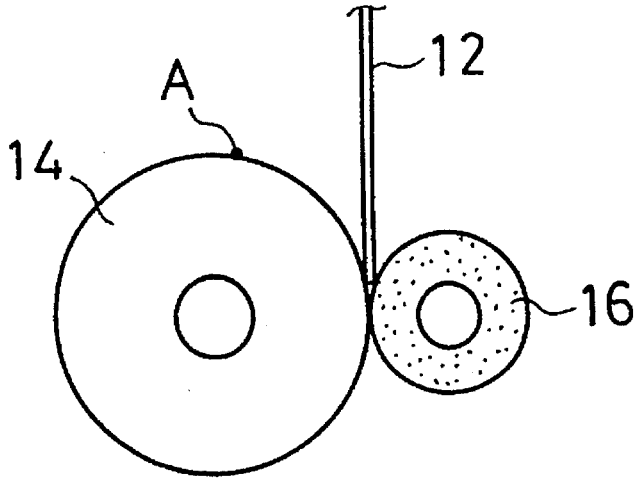
FIG. 10A is an illustrative view showing a waiting state in the FIG. 9 embodiment of a paper downward feeding system, and the FIG. 10B is an illustrative view showing a transferring state in FIG. 9 embodiment.
Figure 10B:
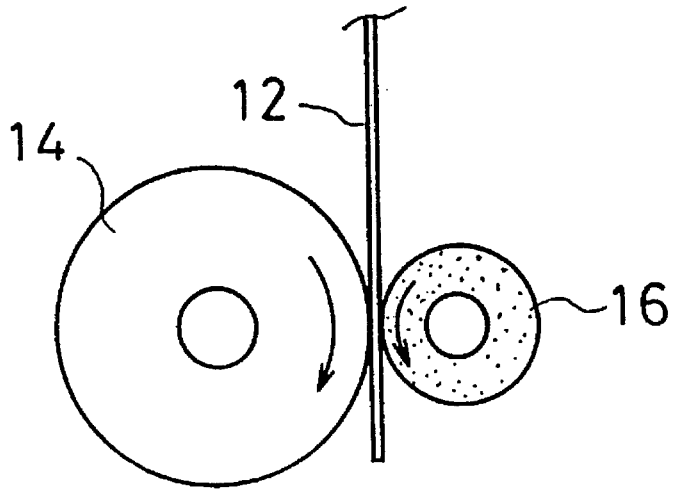

The waiting state is a state where the leading end of the paper 12 comes between the contact point of the photosensitive drum 14 and the transfer roller 16 as shown in FIG. 10A, and when the printing operation is started, the rotation of the photosensitive drum 14 is first started while the transfer roller 16 is stopped. Thereafter, by starting the rotation of the transfer roller 16 at a time that a point A (FIG. 10A) that is a leading end portion of a toner image on the photosensitive drum 14 is made be coincident with a leading end position of an image on the paper 12, the paper 12 is fed-in between the photosensitive drum 14 and the transfer roller 16 as shown in FIG. 10B, and therefore, the toner image is transferred onto the paper 12 from the photosensitive drum 14.

Next, in a step S53, the trailing end of the paper 12 being fed is detected by the trailing end sensor 72, and therefore, the trailing end sensor 72 is turned-off, and in response thereto, the supply of the charging voltage to the discharger 26 is stopped in a step S55, the laser 28 is turned-off in a step S57, the transfer motor 42 is turned-off in a step S59, and the main motor 38 is turned-off in a step S61, the supply of the developing bias to the developer 32 is stopped in a step S63, and accordingly, the image forming operation is terminated.

Figure 13:
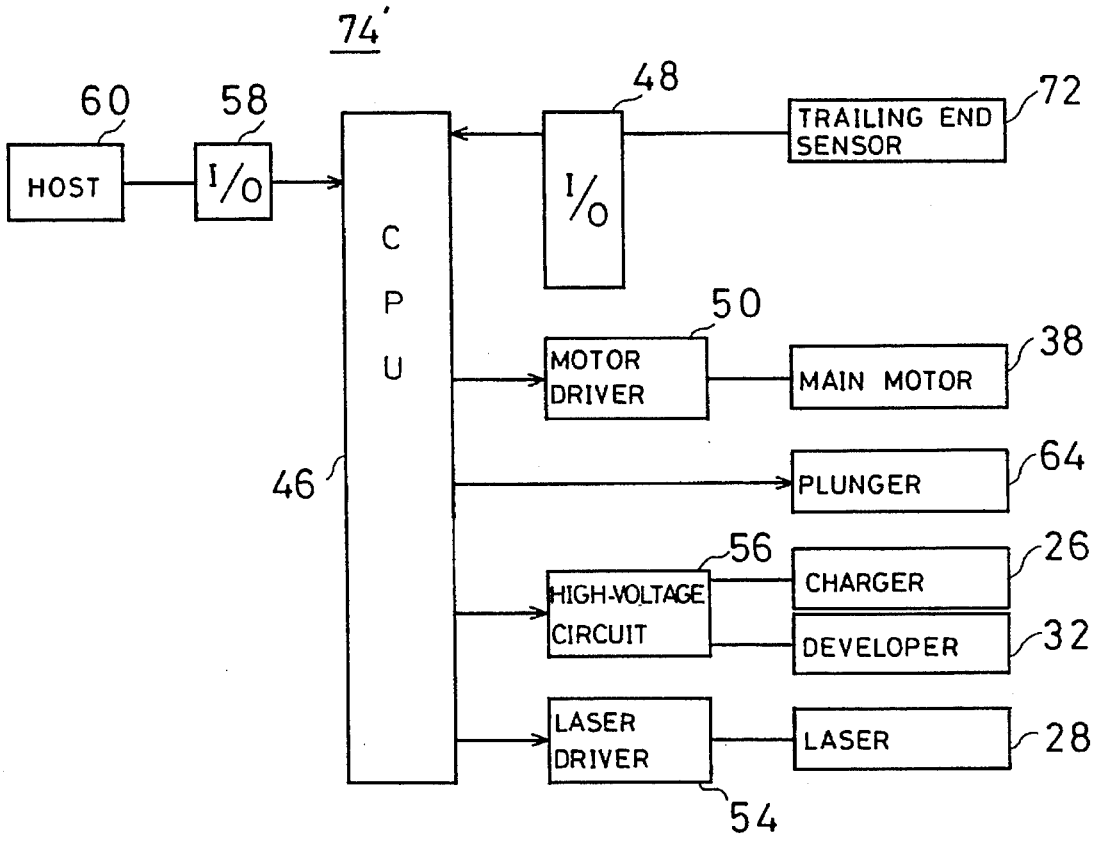
FIG. 13 is a block diagram showing the circuit of an image forming apparatus in which the major portion of the FIG. 6 is incorporated in FIG. 9 embodiment.

In addition, as the major portion of the image forming apparatus 70 shown in FIG. 9, the major portion having the structure shown in FIG. 6 may be utilized. At this time, a control circuit 74' is constituted as shown in FIG. 13. In the control circuit 74', the motor driver 52 included in the control circuit 74 shown in FIG. 11 is omitted, and the plunger 64 is directly controlled by the CPU 46.

Figure 14:
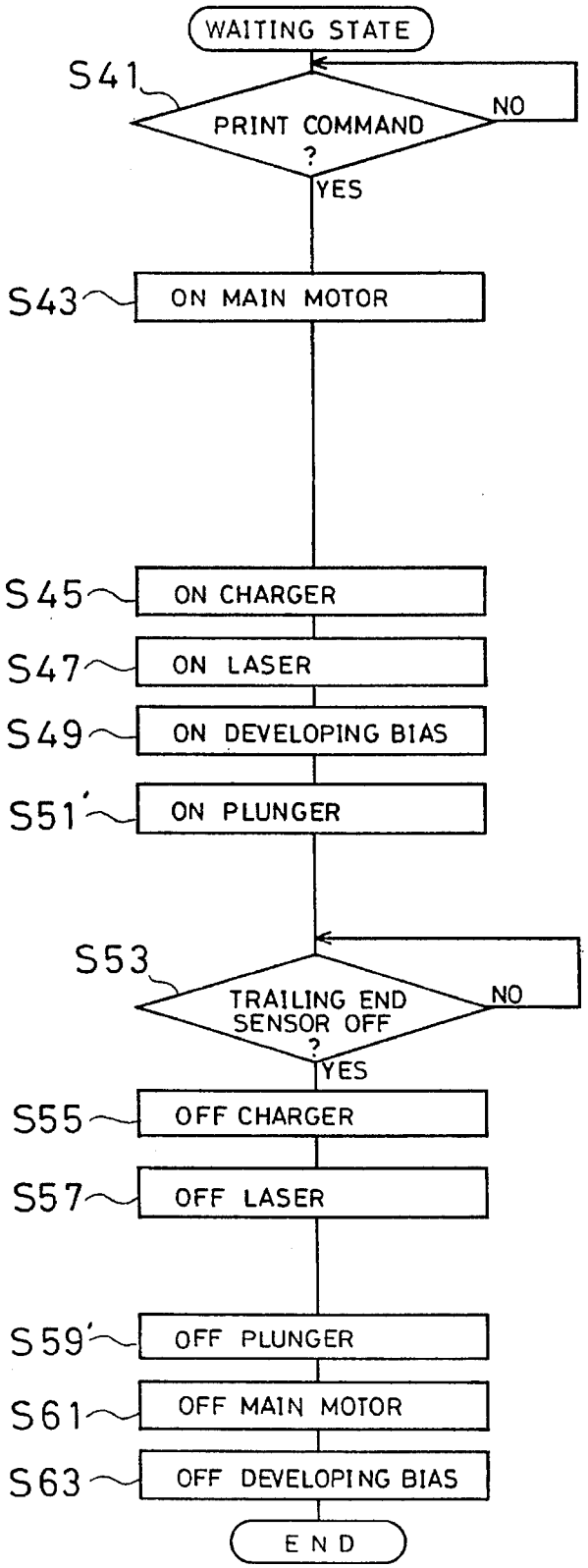
FIG. 14 is a flowchart showing an operation of the FIG. 13 embodiment.

An operation of such an embodiment is shown in FIG. 14. Since the plunger 64 is utilized instead of the transfer motor 42, operations in the steps S51 and S59 shown in FIG. 12 are changed to the turning-on/off operations of the plunger 64 in steps S51 and S59 shown in FIG. 14. The remaining operations are the same or similar to that of FIG. 12, and therefore, a duplicate description is omitted With referring to FIG. 15, an image forming apparatus 80 of another embodiment according to the present invention will be described. In the image forming apparatus 80 of this embodiment, the paper 12 is fed in a horizontal direction as shown in FIG. 16A and 16B.

The image forming apparatus 80 includes a paper supply unit 82 which is constructed as a cassette detachably attached to the body 18. Within the paper supply unit 82, a paper supply roller 84 for supplying the paper 12 toward the transfer roller 16 from the paper supply unit 82, and a PE sensor 86 for detecting whether or not the paper 12 is accommodated in the paper supply unit 82 are arranged.

Figure 17:
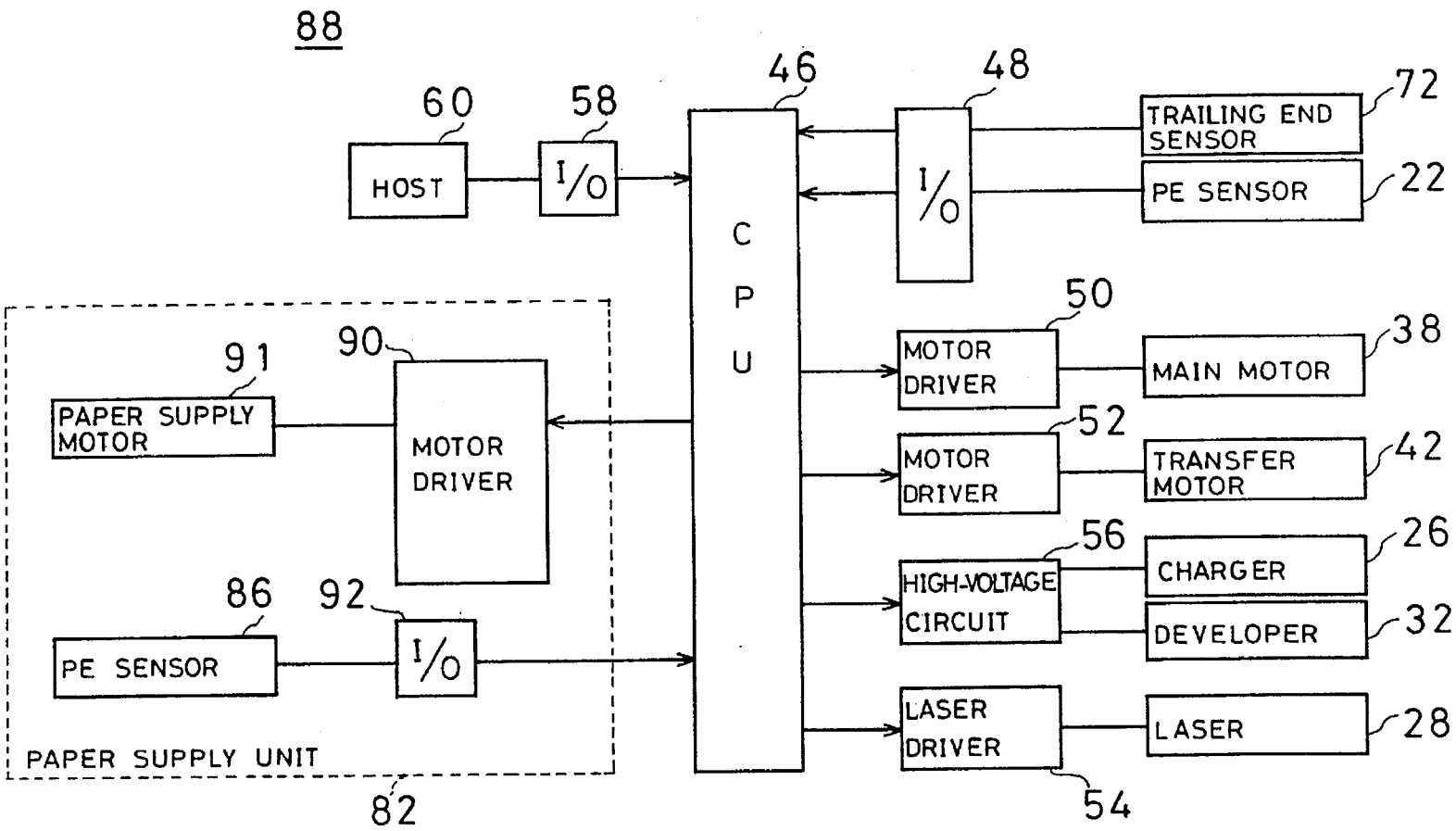
FIG. 17 is a block diagram showing an image forming apparatus in which the major portion of the apparatus of FIG. 3 is incorporated in FIG. 15 embodiment.

In a case where the major portion shown in FIG. 3 is utilized in the image forming apparatus 80, a control circuit 88 shown in FIG. 17 is incorporated in the housing 12. As shown in FIG. 17, a motor driver 90 for the paper supply unit 82 is controlled by the CPU 46 included in the control circuit 88, and a paper supply motor 91 is driven by the motor driver 90. Accordingly, the paper supply roller 84 is rotated. In addition, an output from the PE sensor 86 is applied to the CPU 46 via an I/O interface 92, and the PE sensor 22 and the trailing end sensor 72 are coupled to the CPU 46 via the I/O interface 48. The remaining structural portions of the control circuit 88 are the same or similar to that of the control circuit 44 shown in FIG. 4, and therefore, a duplicate description will be omitted here.

Figure 18:
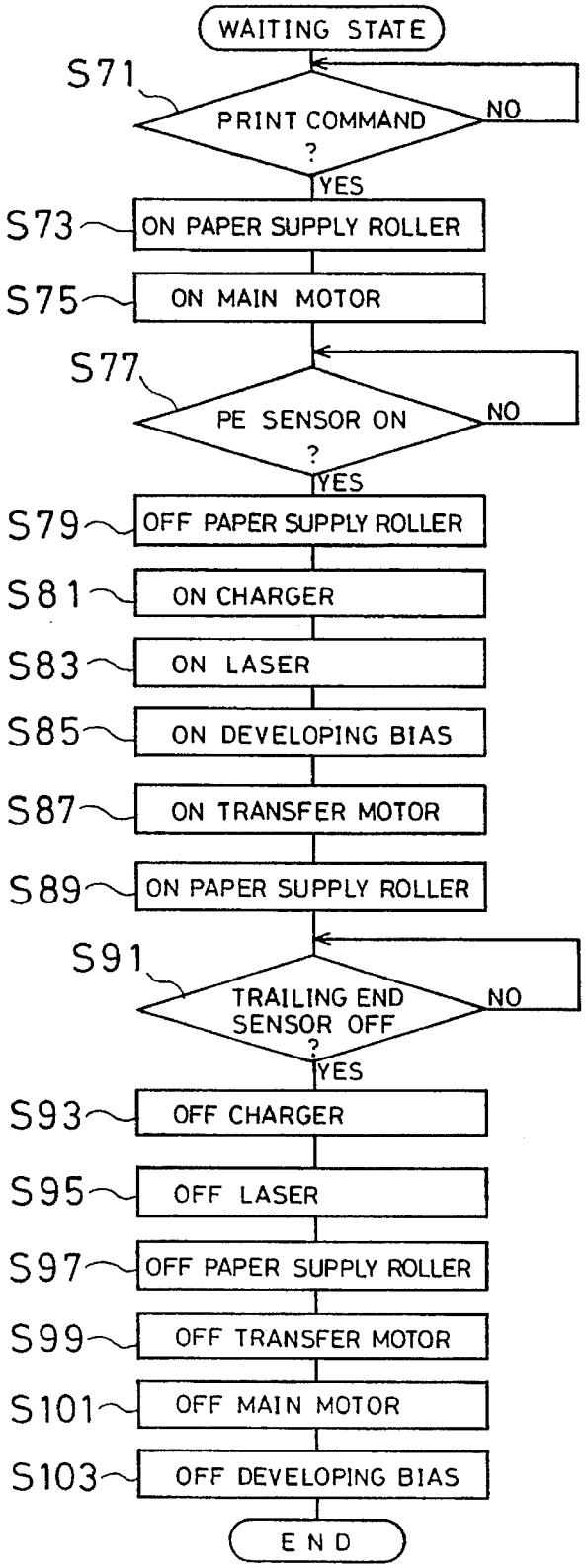
FIG. 18 is a flowchart showing an operation of the FIG. 17 embodiment.

Referring to FIG. 18, an operation of the image forming apparatus 80 will be described. In addition, as a premise, the paper 12 is accommodated within the paper supply unit 82.

At first, when a print command from the host device 60 is applied to the image forming apparatus 80 being in a waiting state in a step S71, the printing operation is started. The paper supply roller 84 is turned-on in a step S73, and the main motor 38 is turned-on in a step S75. Therefore, the paper 12 is fed-in toward the contact point of the photosensitive drum 14 and the transfer roller 16 by the paper supply roller 84, and when the PE sensor 22 is turned-on in a step S77, the paper supply roller 84 is turned-off after a predetermined time. Resultingly, the paper 12 is fed-in to the contact point of the photosensitive drum 14 and the transfer roller 16, and the leading end portion of the paper 12 is bent as shown in FIG. 16A by the feeding force. Therefore, the leading end of the paper 12 is stopped by the contact point of the photosensitive drum 14 and the transfer roller 16, and the apparatus 80 temporarily assumes the waiting state. In addition, at this time point, the transfer roller 16 remains in its stopped state while the main motor 38 remains in its on state.

Next, a charging voltage is applied to the charger 26 in a step S81, the laser 28 is turned-on in a step S83, a developing bias is applied to the developer 32 in a step S85, the transfer motor 42 is turned-on in a step S87, and the paper supply roller 84 is turned-on in a step S89, so that the printing operation is performed. At this time, by starting the rotation of the transfer roller 16 at a timing that a point A (FIG. 16A) that is a leading end portion of the toner image on the photosensitive drum 14 is coincident with a leading end position of an image on the paper 12, the paper 12 is fed-in between the photosensitive drum 14 and the transfer roller 16, and therefore, the toner image is transferred onto the paper 12 from the photosensitive drum 14, as shown in FIG. 16B.

Thereafter, when the trailing end of the paper 12 is detected by the trailing end sensor 72, that is, when the trailing end sensor 72 is turned-off in a step S91, the supply of the charging voltage to the charger 26 is turned-off in a step S93, the laser 28 is turned-off in a step S95, the paper supply roller 84 is tuned-off in a step S97, the transfer motor 42 is turned-off in a step S99, the main motor 38 is turned-off in a step S101, and the supply of the developing bias to the developer 32 is turned-off in a step S103, so that the image forming operation is terminated.

Figure 15:
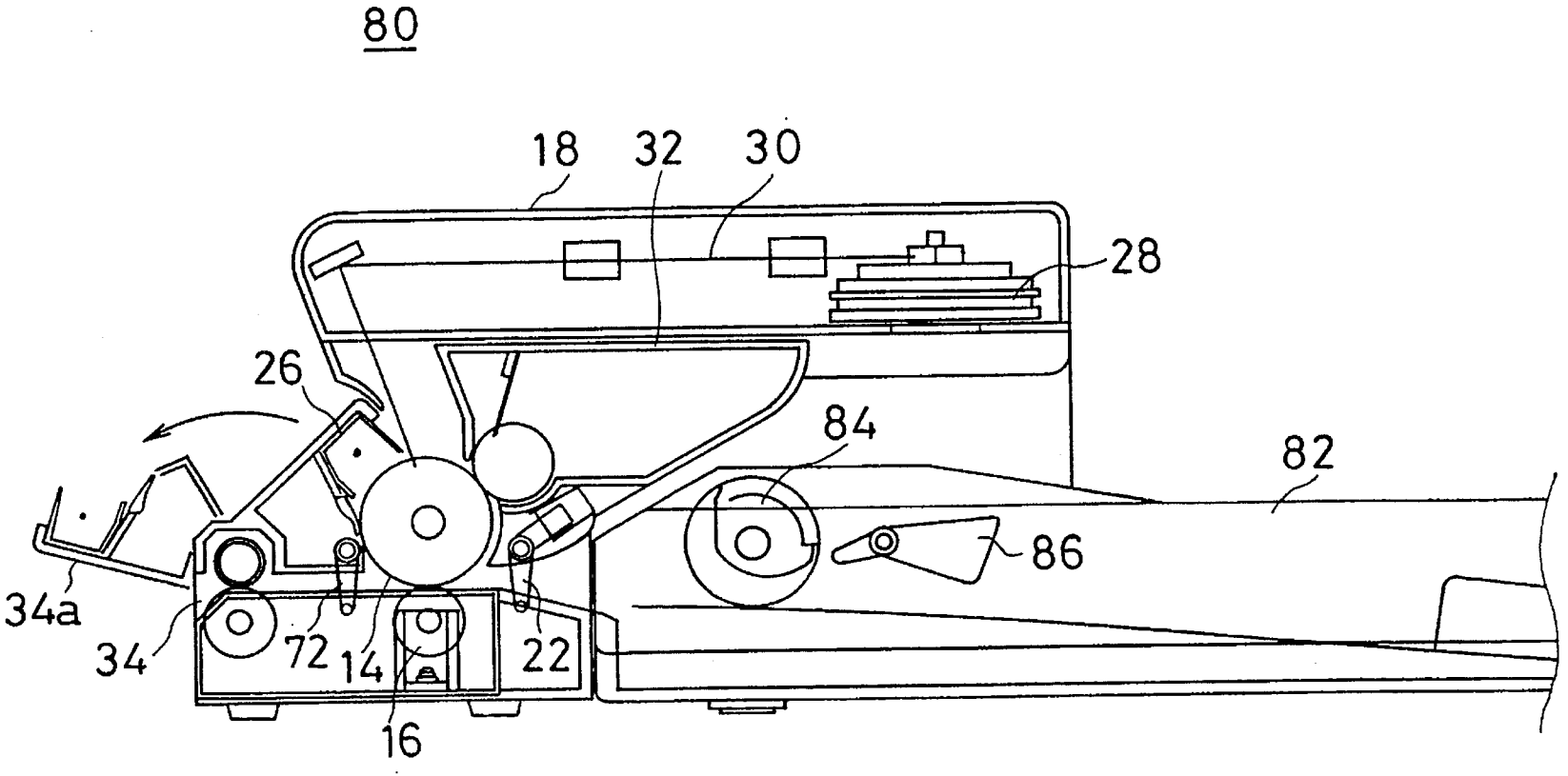
FIG. 15 is a cross-sectional view illustrative view showing an image forming apparatus of another embodiment according to the present invention.
Figure 16A:
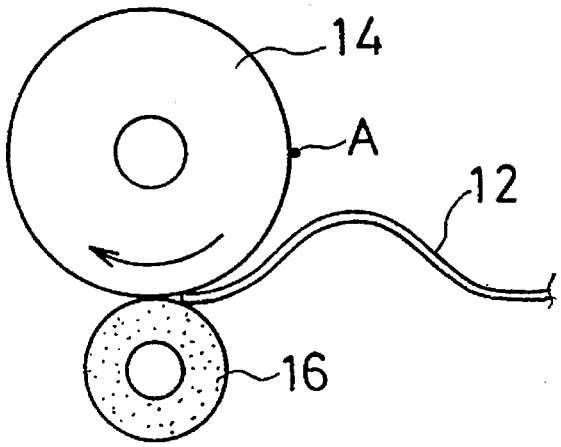
FIG. 16A is an illustrative view showing a waiting state in the FIG. 15 embodiment of another horizontal paper feeding system.
Figure 16B:
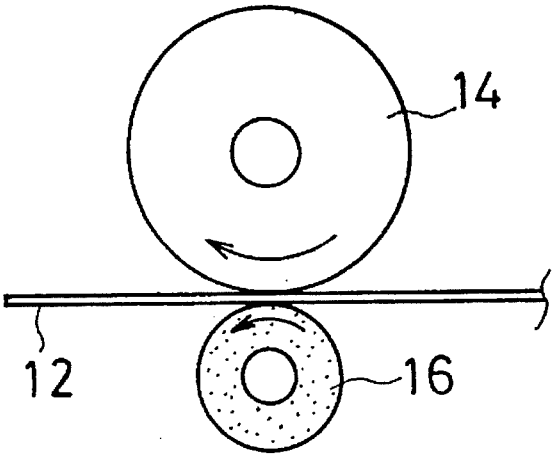
FIG. 16B is an illustrative view showing a transferring state in the FIG. 15 embodiment.
Figure 19:
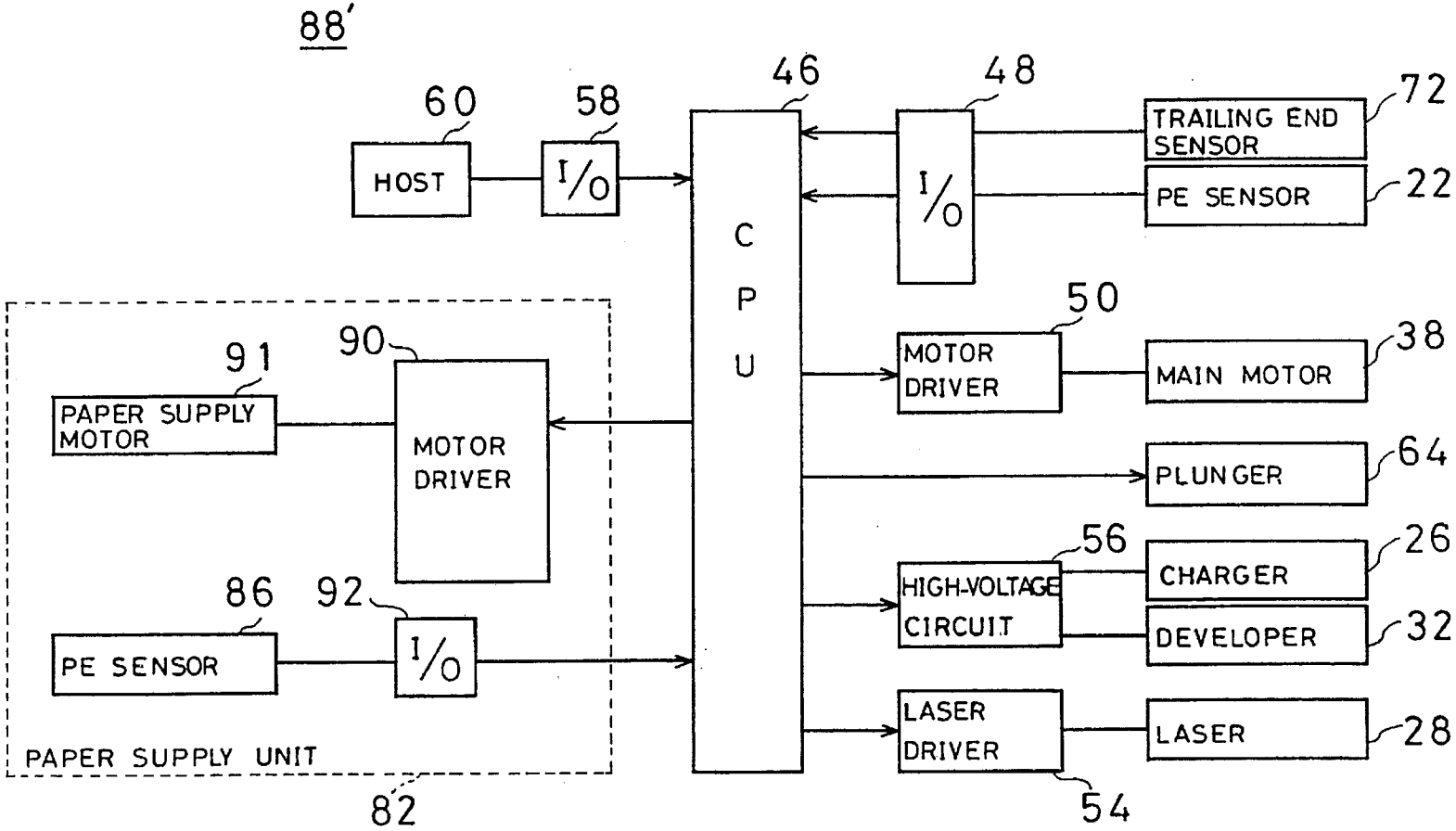
FIG. 19 s a block diagram showing an image forming apparatus in which the major portion of the apparatus of FIG. 6 is incorporated in FIG. 15 embodiment.

As the major portion of the image forming apparatus 80 shown in FIG. 15, the major portion having the structure shown in FIG. 6 may be utilized. In the image forming apparatus 80 utilizing the major portion shown in FIG. 6, a control circuit 88' is constructed as shown in FIG. 19. In the control circuit 88', the motor driver 52 of the control circuit 88 shown in FIG. 17 is omitted, and the plunger 64 is directly controlled by the CPU 46. The remaining structural portions of the control circuit 88' are the same or similar to that of the control circuit 88 shown in FIG. 17, and therefore, a duplicate description is omitted here.

Figure 20:
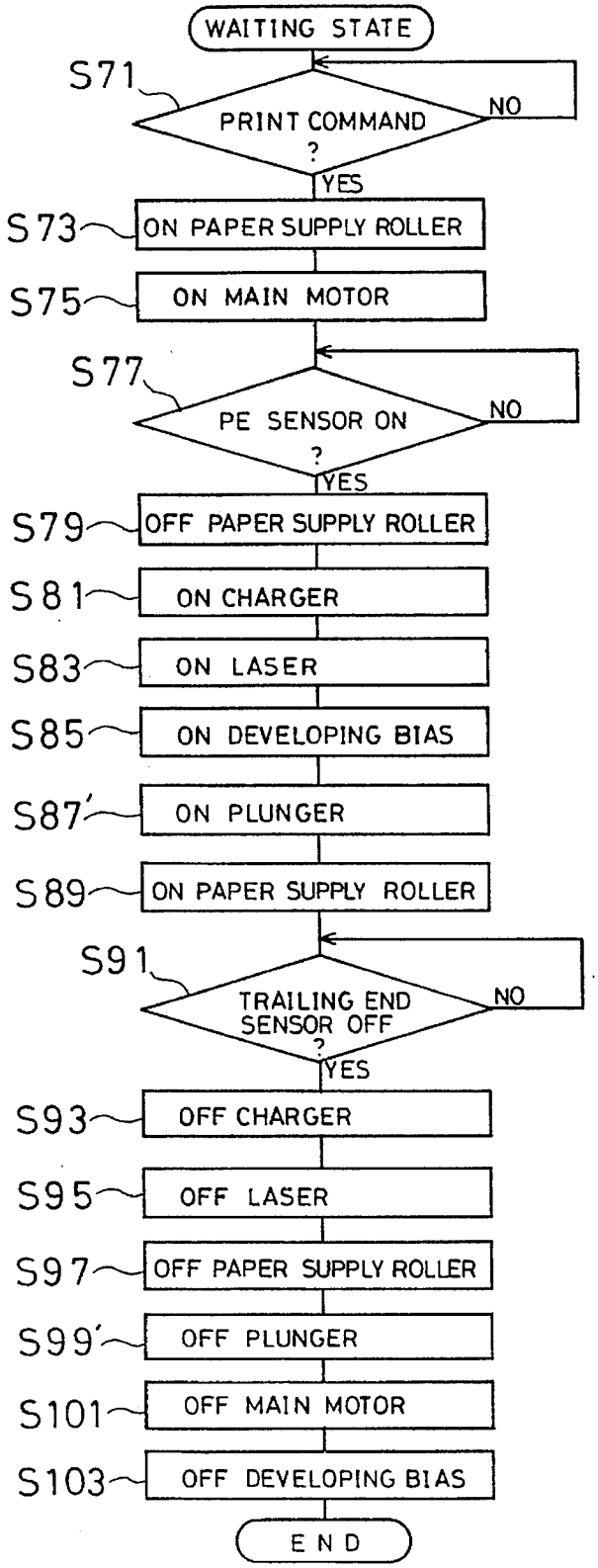
FIG. 20 is a flowchart showing an operation of the FIG. 19 embodiment.

An operation of the image forming apparatus 80 including the major portion shown in FIG. 6 will be described with referring to FIG. 20. In comparison with the operation shown in FIG. 18, the operation shown in FIG. 20 is different from that of FIG. 18 only the point that the plunger 64 is utilized instead of the transfer motor 42, and therefore, operations in the steps S87 and S99 shown in FIG. 18 are changed to the turned-on/off of the plunger 64 in steps S87' and S99' shown in FIG. 20. Since other portions of the operation are the same or similar to that of FIG. 18, a duplicate description is omitted.

In the above described embodiments, by stopping the transfer roller 16, it is possible to hold the position at the leading end of the paper 12 at a constant or predetermined position. Then, by rotating the transfer roller 16 in synchronization of the rotation of the photosensitive drum 14, the leading end of the image forming area on the photosensitive drum 14 can be made coincident with the leading end on the image forming area on the paper 12.

In the above described embodiments, as different from the conventional apparatus, no paper supply roller is provided within the body 18, and only two kinds of rollers, that is, the transfer roller 16 and the fixing roller of the fixing device 34 are provided for feeding the paper 12.

Therefore, in a case where the paper jam occurs between the photosensitive drum 14 and the transfer roller 16, in the conventional apparatus, three portions associated with three kinds of rollers must be opened; however, in the above described embodiments, only two portions associated with the transfer roller 16 and the fixing roller may be opened. In FIG. 15 embodiment, for example, a cover 34*a* for supporting the charger 26 and for covering the fixing device 34 may be made be opened. In addition, as necessary, the paper supply unit 82 may be detached such that the paper 12 occurring the jam can be removed. Accordingly, in the above described embodiments, the opening/closing mechanism for removing the paper jam may be provided in association with a portion between the photosensitive drum 14 and the fixing device 34, and therefore, the structure of the image forming apparatus becomes simpler and it is possible to reduce a cost of the apparatus largely.

Furthermore, by utilizing the opening/closing mechanism which is opened for releasing the paper jam, the photosensitive drum 14 can be attached or detached. More specifically, since one side of the photosensitive drum 14 is largely opened by opening the cover 34*a*, the photosensitive drum 14 can be withdrawn in a direction of the diameter of the drum 14, and therefore, the exchange of the photosensitive drum 14 can be performed from a side of the fixing device 34. Therefore, it is possible to make a space that is to be secured around the image forming apparatus for maintenance can be minimized, and therefore, according to the above described embodiments, a space saving can be performed.

Furthermore, in the above described embodiments, during the waiting state, preferably, a voltage is applied to the transfer roller 16, and a resistance value of the paper 12 is measured on the basis of a current value or a voltage value at that time, and in accordance with the resistance value of the paper 12, the transfer voltage in transferring the toner image onto the paper 12 may be adjusted. More specifically, in the above described embodiments, since the rotation of the transfer roller 16 is stopped in a state that the transfer roller 16 is brought into contact with the paper 12, the resistance value of the paper 12 can be measured by applying the voltage to the transfer roller 16. By adjusting or controlling the transfer voltage, it is possible to apply an optimum transfer voltage to the transfer roller 16, and therefore, a quantity of an image on the paper 12 can be made higher.

In addition, in the image forming apparatus 10 shown in FIG. 1, the leading end position of the toner image on the paper 12 is fixed on the basis of the position of the leading end sensor 24; however, the transfer roller 16 can be controlled independently from the photosensitive drum 14, and therefore, the leading end position of the image on the paper 12, that is, a margin on the paper 12 can be adjusted by further rotating the transfer roller 16 in a forward direction or a backward direction. For performing such an operation, operations for "forward rotation (or backward rotation) of the transfer motor 42" and "turning-off the transfer motor 42" may be inserted between the step S11 (S11') and the step 13 shown in FIG. 5 or FIG. 8.

Furthermore, in the above described embodiments, the present invention is embodied in a printing apparatus, but the present invention can be applied to a copying machine.

Furthermore, an arbitrarily sensor such as a photocoupler and etc. may be utilized for the PE sensor 22, the leading end sensor 24 and the trailing end sensor 72.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

an image forming member;

a transfer roller for transferring a toner image formed on said image forming member onto a paper, a leading end portion of the paper being brought into contact with a contact point between said image forming member and said transfer roller and being bent after being fed, at least when in a mis-registration state and control means for controlling rotation of said transfer roller independently from operation of said image forming member and stopping the rotation of said transfer roller before said toner image is transferred to said paper when the paper leading end portion is bent.

2. An image forming apparatus according to claim 1, wherein said control means includes first detecting means for detecting a paper fed to said transfer roller, and a transfer motor for controlling rotation of said transfer roller, and said transfer roller being rotated by said transfer motor in response to a detection by said first detecting means.

3. An image forming apparatus according to claim 1, further comprising a paper supply unit in which paper is accommodated, a paper supply roller for supplying paper to said transfer roller from said paper supply unit, and input means for inputting a command for image forming, wherein the paper is fed by said paper supply roller in response to the command from said input means.

4. An image forming apparatus according to claim 11, wherein said control means includes first detecting means for detecting a paper fed to said transfer roller, and a transfer motor for controlling rotation of said transfer roller, and said transfer roller being rotated by said transfer motor after a predetermined time when the paper is detected by said first detecting means.

5. An image forming apparatus comprising:

an image forming member;

a transfer roller for transferring a toner image formed on said image forming member onto a paper; and control means for controlling rotation of said transfer roller independently from operation of said image forming member, said control means including second detecting means for detecting a paper fed from said transfer roller, and a transfer motor for controlling rotation of said transfer roller, and said transfer roller being stopped by said transfer motor in response to a detection by said second detecting means.

6. An image forming apparatus comprising:

an image forming member;

a transfer roller for transferring a toner image formed on said image forming member onto a paper; and control means for controlling rotation of said transfer roller independently from operation of said image forming member, said control means including second detecting means for detecting a paper fed from said transfer roller, and a transfer motor for controlling rotation of said transfer roller, and said transfer roller being rotated in a forward direction or a backward direction by said transfer motor in response to a detection by said second detecting means such that the paper can be fed to a desired position.

7. An image forming apparatus comprising:

an image forming member;

a transfer roller for transferring a toner image formed on said image forming member onto a paper; and control means for controlling rotation of said transfer roller independently from operation of said image forming member;

input means for inputting a command for image forming, said control means including a transfer motor for controlling rotation of said transfer roller, and said transfer roller being rotated by said transfer motor in response to the command from said input means.

8. An image forming apparatus according to claim 7, wherein said control means includes second detecting means for detecting a paper fed from said transfer roller, and said transfer roller being stopped by said transfer motor when the paper is not detected by said second detecting means.

9. An image forming apparatus comprising:

an image forming member;

a transfer roller for transferring a toner image formed on said image forming member onto a paper; and control means for controlling rotation of said transfer roller independently from operation of said image forming member, said transfer roller being driven by the operation of said image forming member, and said control means including first detecting means for detecting a paper fed to said transfer roller, and a plunger for controlling rotation of said transfer roller, and said transfer roller not being stopped by said plunger even when the paper is detected by said first detecting means.

10. An image forming apparatus comprising:

an image forming member;

a transfer roller for transferring a toner image formed on said image forming member onto a paper; and control means for controlling rotation of said transfer roller independently from operation of said image forming member, said transfer roller being driven by the operation of said image forming member, and said control means including second detecting means for detecting a paper fed from said transfer roller, and a plunger for controlling a rotation of said transfer roller, and said transfer roller being stopped by said plunger when the paper is detected by said second detecting means.

11. An image forming apparatus comprising:

an image forming member;

a transfer roller for transferring a toner image formed on said image forming member onto a paper; and control means for controlling rotation of said transfer roller independently from operation of said image forming member;

input means for inputting a command for image forming, wherein said transfer roller is driven by the operation of said image forming member, and said control means includes a plunger for controlling rotation of said transfer roller, and said transfer roller not being stopped by said plunger even when the command is inputted by said input means.

12. An image forming apparatus according to claim 11, wherein said control means includes second detecting means for detecting a paper fed from said transfer roller, and said transfer roller is stopped by said plunger when the paper is not detected by said second detecting means.

13. An image forming apparatus comprising:

an image forming member;

a transfer roller for transferring a toner image formed on said image forming member onto a paper; and control means for controlling rotation of said transfer roller independently from operation of said image forming member;

a paper supply unit in which paper is accommodated, a paper supply roller for supplying the paper to said transfer roller from said paper supply unit, and input means for inputting a command for image forming, wherein the paper is fed by said paper supply roller in response to the command from said input means, said control means including second detecting means for detecting a paper fed from said transfer roller, and a transfer motor for controlling a rotation of said transfer roller, said transfer roller being stopped by said transfer motor when the paper sheet is not detected by said second detecting means.

14. An image forming apparatus comprising:

an image forming member;

a transfer roller for transferring a toner image formed on said image forming member onto a paper; and control means for controlling rotation of said transfer roller independently from operation of said image forming member;

a paper supply unit in which paper is accommodated, a paper supply roller for supplying paper to said transfer roller from said paper supply unit, and input means for inputting a command for image forming, wherein paper is fed by said paper supply roller in response to the command from said input means, said transfer roller being driven by the operation of said image forming member, and said control means including first detecting means for detecting a paper fed to said transfer roller, and a plunger for controlling a rotation of said transfer roller, said transfer roller not being stopped by said plunger even when the paper is detected by said first detecting means.

15. An image forming apparatus comprising:

an image forming member;

a transfer roller for transferring a toner image formed on said image forming member onto a paper; and control means for controlling rotation of said transfer roller independently from operation of said image forming member;

a paper supply unit in which a paper is accommodated, a paper supply roller for supplying paper to said transfer roller from said paper supply unit, and input means for inputting a command for image forming, wherein paper is fed by said paper supply roller in response to the command from said input means, and wherein said transfer roller is driven by the operation of said image forming member, and said control means including second detecting means for detecting a paper fed from said transfer roller, and a plunger for controlling rotation of said transfer roller, said transfer roller being stopped by said plunger when the paper is not detected by said second detecting means.

* * * * *